United States Patent [19]

House et al.

[11] Patent Number: 4,944,276

[45] Date of Patent: Jul. 31, 1990

[54] PURGE VALVE FOR ON BOARD FUEL VAPOR RECOVERY SYSTEMS

[75] Inventors: William J. House, Sterling Heights, Mich.; Loren H. Kline, Oregon, Ohio; Lawrence McAuliffe, Jr., Southfield, Mich.

[73] Assignee: Colt Industries Inc, New York, N.Y.

[21] Appl. No.: 209,511

[22] Filed: Jun. 22, 1988

Related U.S. Application Data

[63] Continuation of Ser. No. 109,044, Oct. 6, 1987, abandoned.

[51] Int. Cl.[5] ..... F02M 33/02

[52] U.S. Cl. ..... 123/520; 123/525; 137/614.21

[58] Field of Search ..... 123/520, 525, 1 A; 137/614.21; 251/129.05, 129.15, 129.2

[56] References Cited

U.S. PATENT DOCUMENTS

| | | | |
|---|---|---|---|
| 3,538,951 | 11/1970 | Brownass | 137/614.21 |
| 4,399,780 | 8/1983 | Lassanke et al. | 123/525 |
| 4,489,699 | 12/1984 | Poehlman | 123/525 |
| 4,512,323 | 4/1985 | Ruth et al. | 123/525 |
| 4,700,683 | 10/1987 | Uranishi et al. | 123/520 |
| 4,703,737 | 11/1987 | Cook et al. | 123/520 |

OTHER PUBLICATIONS

*Research Disclosure* "Vapor Purge Control", Oct. 1978.

*Primary Examiner*—A. Michael Chambers
*Attorney, Agent, or Firm*—Howard S. Reiter

[57] ABSTRACT

A purge valve for a vehicle mounted fuel vapor recovery system is made up of a main housing and two end caps which snap fit together to seal and mount a computer controlled solenoid valve and a diaphragm controlled regulating valve. The housing is designed so that the required valve seats are integrally molded in the housing as are the various internal passages and chambers. A compression post formed on one end cap seats the solenoid assembly firmly against an abutment surface on the housing.

10 Claims, 1 Drawing Sheet

PURGE VALVE FOR ON BOARD FUEL VAPOR RECOVERY SYSTEMS

Figures 1, 2:
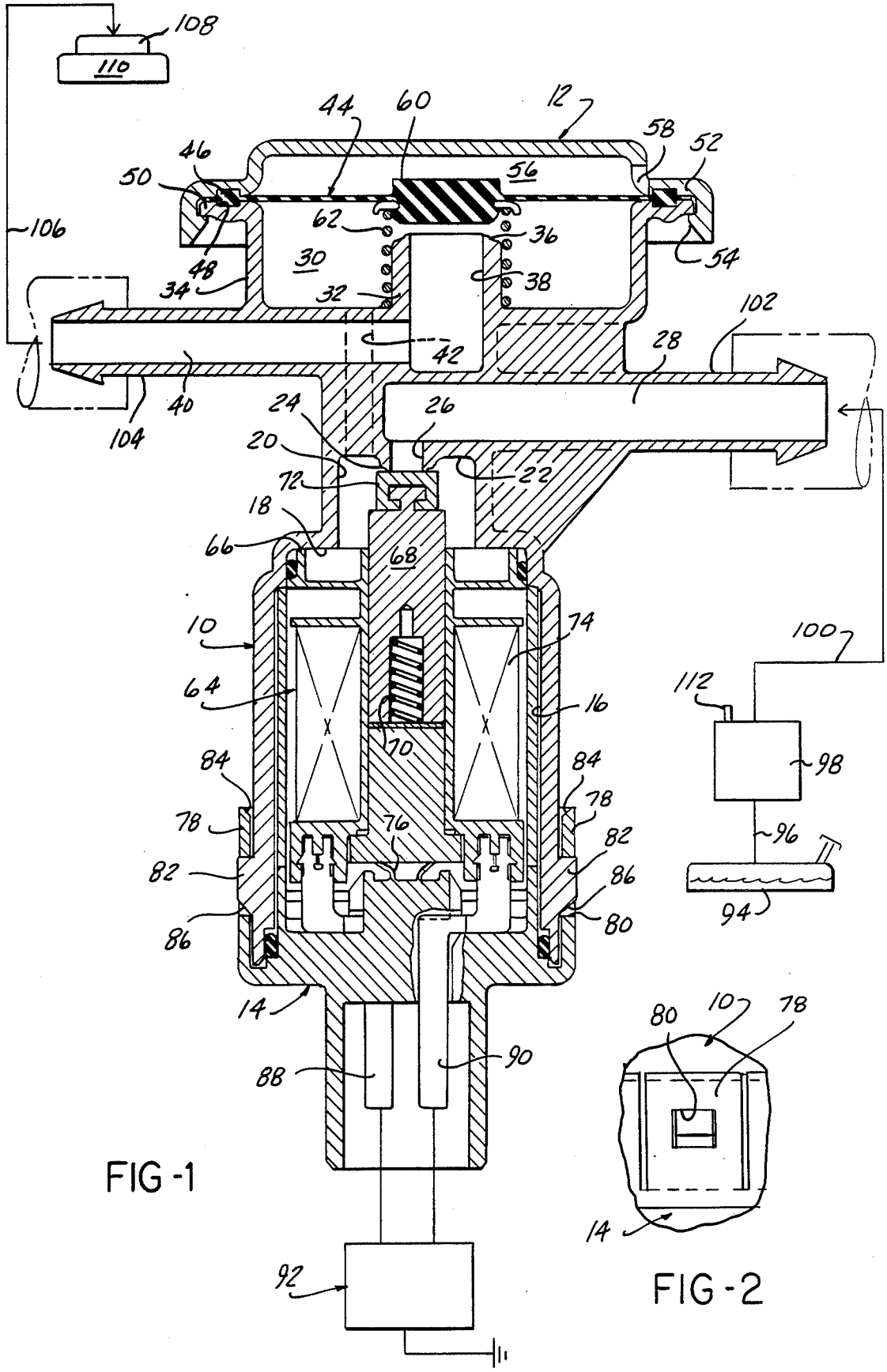

This is a Continuation Application of Ser. No. 07/109,044 Filed Oct. 16, 1987 and now abandoned.

BACKGROUND OF THE INVENTION

To minimize the venting of fuel vapor into the atmosphere, many present day vehicles are equipped with a fuel vapor recovery system which employs a charcoal filled vapor canister which stores fuel vapor vented from the fuel tank. The canister is connected to the intake manifold of the vehicle engine so that during operation of the engine vapor is withdrawn from the canister into the manifold for combustion in the engine.

For various reasons, the rate at which vapor is transferred from the canister to the engine for combustion must be precisely controlled, the primary reason being to avoid overly enriching the fuel mixture as controlled by the carburetor, fuel injection or other fuel system. Thus, it is customary to employ a so-called purge valve to control this flow from the storage canister to the intake manifold.

Operation of the purge valve is typically under the control of a computer programmed to open and close the canister to intake flow passage at an intermittent rate determined by various operating characteristics monitored by the computer. Essentially, the computer functions to open the flow passage at a cyclic frequency, which may be varied by the computer, for a selected portion of each cycle, which portion may also be varied by the computer. When the flow passage is so opened, flow of vapor wil be dependent upon the vacuum or negative pressure existing at that time in the intake manifold and this in turn may vary with engine speed. Thus, in addition to controlling the flow by cyclically opening the valve, the purge valve must also include some means for regulating the rate of flow while the valve is open.

The present invention is especially directed to a purge valve which incorporates a computer controlled solenoid actuated valve and a regulating valve responsive to intake manifold vacuum commonly mounted within a three part housing formed of molded plastic elements incorporating internal passages and valve seats integrally formed in the various housing components.

SUMMARY OF THE INVENTION

In accordance with the present invention, a purge valve embodying the present invention includes a vertically elongate main housing having an annular recess formed in its upper end. A flexible diaphragm overlies the open upper end of this annular recess and is sealed around its periphery to the main housing to define an annular chamber having an outlet to the engine intake manifold in the form of a passage extending axially downwardly from an upwardly facing valve seat at the center of the annular chamber. The diaphragm is held in sealed engagement with the main housing by a downwardly concave end cap snap fitted onto the top of the housing and vented to atmosphere. A compression spring biases the diaphragm upwardly away from the valve seat while the outlet passage of the annular chamber below the diaphragm is connected to the intake manifold. Vacuum in the intake manifold draws the diaphragm downwardly toward the valve seat so that the outlet of the annular chamber is closed by the engagement of the diaphragm with the upwardly facing valve seat at a predetermined difference in pressure between atmospheric pressure at the top side of the diaphragm and the absolute pressure of the vacuum at the under side of the diaphragm.

A stepped bore extending upwardly into the housing from its lower end provides a relatively large diameter chamber terminating at a radially inwardly projecting annular shoulder which is adapted to receive a cylindrical solenoid assembly. One end of the solenoid assembly is held in place against the radial shoulder by means of a second end cap snap fitted onto the bottom of the housing. This second end cap is formed with an upwardly projecting compression post which is compressed against the bottom of the solenoid assembly when the end cap is seated on the housing to firmly press the solenoid assembly upwardly against the downwardly facing radial shoulder. A solenoid armature projects from the solenoid assembly upwardly into a smaller diameter chamber whose inlet is constituted by a downwardly facing valve seat at the upper end of the small diameter chamber through which an inlet passage adapted to be connected to a fuel vapor source extends. The solenoid armature is normally biassed upwardly by a spring to press a valve head at the upper end of the armature against this last valve seat to normally block communication between the small diameter chamber and the inlet passage. Energization of the solenoid via electrical connection means in the lower end cap retracts the armature downwardly clear of the valve seat to place the small diameter chamber in communication with the inlet passage. An internal passage leads from the small diameter chamber into the annular chamber at the upper end of the main housing.

Other objects and features of the invention will become apparent by reference to the following specification and to the drawings.

IN THE DRAWINGS

FIG. 1 is a detail cross-sectional veiw of a purge valve embodying the present invention including a schematic representation of a fuel vapor recovery system in which the valve is employed; and FIG. 2 is a partial side elevational view showing details of a snap finger arrangement employed to couple the lower end cap of the valve of FIG. 1 to its main housing.

A purge valve embodying the present invention includes a vertically elongate main housing designated generally 10 whose upper and lower ends are closed by snap fitting upper 12 and lower 14 end caps. Housing 10 and end caps 12 and 14 are preferably formed, as by injection molding, from any of several suitable thermoplastic materials, such as a glass filled nylon, for example.

Main housing 10 is formed with a relatively large diameter chamber 16 which extends upwardly from the open lower end of housing 10 to a downwardly facing annular radial shoulder 18. A smaller diameter chamber 20 extends upwardly in housing 10 above shoulder 18 in coaxial relationship to chamber 16 to terminate at an upper or inner end 22. A downwardly facing annular value seat 24 is centrally formed at the upper end of chamber 20 and a relatively small diameter passage 26 extends coaxially from chamber 20 through valve seat 24 to open into a horizontal inlet passage 28.

An annular chamber 30 extends downwardly into housing 10 from its upper end betwen concentric inner and outer walls 32, 34 respectively. An annular valve seat 36 is formed at the upper end of inner wall 32 and an outlet passage 38 extends axially downwardly through valve seat 36 to intersect and communicate with an outlet passage 40. A vertical passage indicated at broken line at 42 places chambers 20 and 30 in direct fluid communication with each other at all times. The passage 42 does not intersect or directly communicate with outlet passage 40.

The upper wall of annular chamber 30 is defined by a flexible diaphragm 44 formed with an integral peripherally extending seal ring portion 46 adapted to be seated in sealing engagement within an annular groove 48 formed in the upper side of a radially projecting flange 50 at the upper end of outer wall 34. Diaphragm 44 is sealingly clamped in the assembled position shown in FIG. 1 by end cap 12, a radially projecting flange 52 on end cap 12 pressing the diaphragm against flange 50 of main housing 10. End cap 12 is clamped to housing 12 by a radially inwardly projecting shoulder 54 which is snap fitted into position beneath flange 50 of main housing 10. Upper end cap 12 is of a downwardly concave configuration to define a chamber 56 above diaphragm 44 which is vented to atmosphere via a vent port 58.

Diaphragm 56 is formed with a thickened central section 60 which acts as a valve head engageable with valve seat 36 to seal chamber 30 from outlet passage 38 when the vacuum or subatmospheric pressure in chamber 30 and outlet passage 38 drops to a predetermined amount below the atmospheric pressure acting on the upper side of diaphragm 44. The pressure differential required to accomplish such a seating of valve head 60 on valve seat 36 is determined by the characteristic of a regulating spring 62 which biases diaphragm 44 upwardly.

Large diameter chamber 16 in the bottom of housing 10 is dimensioned to receive a generally cylindrical solenoid assembly designated generally 64 with one end of assembly 64 seated against radial shoulder 18 as at 66. The armature 68 is biassed upwardly by a compression spring 70 to normally engage a valve head 72 carried on the upper end of armature 68 with valve seat 24 to block communication between passage 26 and small diameter chamber 20. Energization of the coil 74 of the solenoid draws armature 68 downwardly to space valve head 72 from seat 24 to place passage 26 in communication with chamber 20.

Solenoid assembly 64 is mechanically held pressed against radical shoulder 18 by a hollow axially compressible post 76 integrally molded on lower end cap 14.

End cap 14 is formed with a plurality of upwardly projecting fingers 78, see also FIG. 2, formed with apertures 80 located to receive outwardly projecting abutment shoulders 82 integrally formed on main housing 10. The upper ends of fingers 78 are beveled as at 84 while the lower sides of abutment shoulders 82 are beveled as at 86. End cap 14 is assembled on main housing 10 simply by pushing the end cap axially upwardly onto the lower end of housing 10. The beveled surfaces 84 and 86 on the end cap and housing cam the fingers 78 outwardly until the openings 80 in fingers 78 are aligned with the abutment shoulders 82, at which time the fingers snap inwardly to lock end cap 14 against axial withdrawal from housing 10. Compression post 76 resiliently collapses to accommodate this mounting and the compressed post 76 firmly presses solenoid assembly 68 upwardly into engagement with abutment shoulder 18. End cap 14 carries externally projecting electrical connector prongs 88, 90 which are employed to electrically connect solenoid coil 74 to a computer switched electrical power source designated generally 92.

In a typical fuel vapor recovery system, the head space of a vehicle fuel tank 94 is connected via a conduit 96 to a vapor storage canister 98, typically filled with charcoal. A condiut 100 connects canister 98 to inlet passage 28 of the purge valve, this condiut 100 being received upon a hose coupling 102 integrally formed on main housing 10 through which inlet passage 28 extends. Outlet passage 40 of the purge valve extends through a second hose coupling 104 and a conduit 106 coupled to coupling 104 connects outlet passage 40 of the purge valve to the intake manifold 108 of the vehicle engine 110.

To equalize pressure in the head space of fuel tank 94 as may be required by the withdrawal of fuel from the tank to run the engine, cansiter 98 is provided with an atmospheric vent 112 which, in effect, allows the head space in the tank to breathe. Evaporation of fuel in tank 94 to generate vapor in the head space of the tank is largely dependent upon the volatility of the fuel and ambient temperature. Canister 20 is filled with charcoal or some other vapor absorbent medium so that the canister essentially acts as an accumulator which stores fuel vapor at substantially atmospheric pressure.

The purge valve described above operates to establish a fluid connection between canister 98 and intake manifold 108 so that vapor can be withdrawn from canister 20 at a controlled rate during running of the engine for combustion in engine 110.

The computer associated with the computer switched electrical supply source 92 to solenoid coil 74 is programmed to cyclically energize coil 74 in pulses of a frequency and time duration determined by the computer in accordance with several operating parameters monitored by the computer. Spring 70 maintains valve head 72 on the solenoid armature seated against valve seat 24 at all times when the solenoid coil is not energized, hence flow of vapor from canister 98 through conduit 100 and passages 28, 26 into chamber 20 is normally blocked by valve head 26 and flow of vapor into chamber 20 can occur only during those periods of time when the solenoid coil 74 is energized.

When solenoid coil 74 is energized, valve head 72 is retracted clear of valve seat 24 and vapor, assuming the presence of a pressure differential, can flow from the canister into chamber 20 and thence from chamber 20 through passage 42 into annular chamber 30. If the diaphragm valve head 60 is clear of seat 36, vapor can then flow from chamber 30 through passages 38, 40 and conduit 106 into intake manifold 108 of the engine for combustion in the engine. The rate at which this flow can occur is dependent upon the vacuum or sub-atmospheric pressure in intake manifold 108, condiut 106, passage 40, 38 and chamber 30. Diaphragm 44 is normally flexed upwardly by the bias of regulating spring 62. The upper side of diaphragm 44 is exposed to atmospheric pressure within chamber 56 while the lower or underside of diaphragm 44 is exposed to the vacuum existing in chamber 30 and passage 38.

With engine 108 running, the pressure in chamber 30 and passage 38 will normally be sub-atmospheric and the pressure differential across diaphragm 44 will thus be dependent essentially upon the speed of motor 110, the higher the motor speed, the greater the pressure differential. Downward movement of diaphragm 44 in response to this pressure differential is resisted by spring 62. Spring 62 is formed with a spring characteristic which will accommodate seating of the diaphragm valve head 60 upon valve seat 36 when the pressure differential across the diaphragm reaches a predetermined differential which normally is selected to be somewhere in the range of five to ten inches of water below atmospheric. By limiting the range of pressure differentials over which the diaphragm valve is open, the flow rate of vapor to intake manifold 108 during those periods over which the solenoid valve is opened is substantially constant and at a rate which will assume full combustion in the engine.

The purge valve of the present invention is well adapted for mass production and assembly. The valve seats and internal passages are integrally molded into the one piece main housing 10 and assembly of all of the various valve componenets, including the diaphragm, solenoid and end caps is simply performed by a snap fit operation which does not require the use of any tools.

While one embodiment of the invention has been described in detail, it will be apparent to those skilled in the art the disclosed embodiment may be modified. Therefore, the foregoing description is to be considered exemplary rather than limiting, and the true scope of the invention is that defined in the following claims.

We claim:

1. A purge valve for controlling the flow of vapor from a vapor source to a vacuum source, said valve comprising an elongate generally tubular main housing having a first chamber opening at one axial end of said housing and a second chamber opening at the opposite axial end of said housing, means defining an inlet passage adapted to be connected to a vapor source extending into said housing and an outlet passage adapted to be connected to a vacuum source extending into said housing, means defining a first axial passage extending from said inlet passage to an opening at the inner end of said first chamber, means defining a second axial passage extending from an outlet opening in said second chamber to said outlet passage, means defining a third passage placing said first and second chambers in constant communication with each other, first and second end cap means sealingly mounted at the opposite ends of said main housing to respectively seal said first and second chambers from atmopshere, first solenoid controlled valve means in said housing operable to selectively block or accommodate flow from said first axial passage into said first chamber, and second pressure responsive valve means operable to selectively block or accommodate flow from said second chamber into said second axial passage in response to variations in pressure in said outlet passage.

2. The invention defined in claim 1 further comprising means on said housing defining first and second annular valve seats integrally formed on said housing and respectively projecting axially into each of said first and second chambers coaxially of said first and said second axial passages, said first valve means including a valve head movable into and out of engagement with said first valve seat, and said second valve means including a flexible diaphragm having a central portion movable to and from sealing engagement with said second valve seat in response to variations in pressure in said outlet passage.

3. The ivention defined in claim 2 wherein said diaphragm is clampingly sealed around its outer periphery between said second end cap and said opposite end of said housing, said diaphragm defining a flexible wall common to said second chamber and a third chamber in said end cap vented to atmosphere, and spring means biassing said diaphragm away from said second valve seat.

4. The invention defined in claim 1 wherein said first chamber include a relatively large diameter outer section extending axially inwardly from said one end of said housing and a coaxial relatively small diameter inner section extending inwardly from an annular radial shoulder on said housing at the inner end of said outer section, said solenoid controlled valve means comprising a cylindrical solenoid assembly received within said outer section of said first chamber and having one end seated on said radial shoulder, and an axially compressible port mounted on said first end cap compressively engaged between said first end cap and the opposite end of said solenoid assembly to axially press said assembly against said radial shoulder.

5. A purge valve for controlling the flow of vapor from a vapor source to a vacuum source, said valve comprising a one piece molded vertically elongate main housing having a first bore extending upwardly into said housing from its lower end to a horizontal downwardly facing shoulder, a second bore coaxial with and of a diameter less than said first bore extending upwardly into said housing from said shoulder to an upper end, and a third bore coaxial with and of a diameter less than said second bore extending upwardly into said housing from said upper end of said second bore, means defining an inlet passage adapted to be connected to said vapor source and intersecting said third bore, a downwardly facing annular valve seat on the upper end of said second bore coaxial with said third bore, a generally cylindrical solenoid assembly received within said first bore and having one end engaged with said shoulder, said solenoid assembly including a coil and an armature projecting coaxially upwardly from said one end of said assembly, a valve head on the upper end of said armature, an end cap mounted on the lower end of said housing sealingly closing the lower end of said first bore, integral compression means on said end cap compressively engaged with the lower end of said solenoid assembly pressing said assembly upwardly against said shoulder, spring means in said solenoid assembly biassing said armature upwardly to sealingly engage said valve head with said valve seat to block fluid communication between said second and third bores, electrical connector means in said end cap for connecting said coil to an electric power source, said coil being operable when energized to withdraw said armature downwardly to disengage said valve head from said valve seat to accommodate fluid flow from said third bore into said second bore, means on said housing defining an outlet passage adapted to be connected to a vacuum source, and second valve means in said housing for controlling flow of fluid from said third bore into said outlet passage in accordance with pressure variations in said outlet passage.

6. The invention defined in claim 5 further comprising a plurality of integral upwardly facing shoulders on the exterior of said housing adjacent said lower end, and a plurality of upwardly projecting fingers on said end cap having downwardly facing abutment surfaces adapted to engage said upwardly facing shoulders to retain said end cap on said housing.

7. The invention defined in claim 5 wherein said second valve means comprises means defining an annular recess extending downwardly into said housing from its upper end and communicating with said second bore, an upwardly facing number valve seat on said housing coaxially disposed within said annular recess, said outlet passage opening into said annular recess through said valve seat, a flexible diaphragm sealed around its outer periphery to said housing to close the upper end of said recess, the upper side of said diaphragm being exposed to atmospheric pressure, valve head means on said diaphragm movable upon downward flexing of said diaphragm into sealing engagement with said upwardly facing valve seal to block communication between said annular recess and said outlet passage, and spring means biassing said diaphragm upwardly away from said upwardly facing valve seat.

8. In a vehicle driven by an internal combustion engine, the combination of plurality of fuel system-related components including fuel induction means for the engine, a plurality of separate means each sensing and generating an output signal representative of the instantaneous value of an engine operating parameter, an on-board computer receiving one or more of said sensor output signals and controlling certain engine functions in accordance with certain of said parameters, a fuel storage tank, a fuel vapor canister for storing therein fuel vapors from said tank and purge means for subsequently purging said vapors from said canister to said fuel induction means at a controlled rate for combustion in said engine, said purge means comprising a valve housing having a vapor inlet connected to said canister, a vapor outlet connected to said fuel induction means, and vapor flow passage means extending through said housing from said inlet into an internal chamber and from said chamber to said outlet, first normally closed solenoid actuated valve means in flow passage means between said inlet and said chamber operable upon actuation of its solenoid to accommodate flow of vapor from said inlet into said chamber, and second normally open pressure differential responsive valve means in said flow passage means moveable to a closed position in response to a predetermined reduction in a pressure applied to said outlet by said induction means for controlling the rate of flow of vapor from said chamber into said outlet.

9. The combination of claim 8, wherein said first valve means includes a duty cycle solenoid valve controlled by said computer.

10. The combination of claim 9, wherein said second valve means comprises an engine manifold vacuum responsive diaphragm assembly for limiting the supply of engine manifold vacuum to said chamber so as to establish a desired maximum vapor flow rate to said induction means independently of the opening of said first valve as controlled by said computer.

* * * * *